US009135841B2

(12) United States Patent
Ayad et al.

(10) Patent No.: US 9,135,841 B2
(45) Date of Patent: Sep. 15, 2015

(54) ADVERTISEMENT DISPLAY ASSEMBLY

(75) Inventors: Emad Ayad, Ermington (AU); Filip Tejszerski, Mosman (AU); Annette Panopio, Sydney (AU); Leonard Velich, Sydney (AU); Steven Allen Brenner, Webster Groves, MO (US)

(73) Assignee: iSee Store Innovations, LLC, St. Louis, MO (US)

( * ) Notice: Subject to any disclaimer, the term of this patent is extended or adjusted under 35 U.S.C. 154(b) by 325 days.

(21) Appl. No.: 13/477,902

(22) Filed: May 22, 2012

(65) Prior Publication Data

US 2013/0055603 A1 Mar. 7, 2013

Related U.S. Application Data

(60) Provisional application No. 61/530,084, filed on Sep. 1, 2011, provisional application No. 61/598,126, filed on Feb. 13, 2012.

(51) Int. Cl.

| | |
|---|---|
| ***G09F 7/22*** | (2006.01) |
| ***G09F 19/14*** | (2006.01) |
| ***G09F 11/02*** | (2006.01) |
| *E06B 9/386* | (2006.01) |

(52) U.S. Cl.

CPC ..... *G09F 19/14* (2013.01); *G09F 11/02* (2013.01); *E06B 9/386* (2013.01); *G09F 7/22* (2013.01); *Y10T 29/49826* (2015.01)

(58) Field of Classification Search

CPC ..... E06B 9/386; G09F 7/22
USPC ..... 40/453, 597, 617, 446, 124.13; 160/236, 236.9, 166.1

See application file for complete search history.

(56) References Cited

U.S. PATENT DOCUMENTS

| | | | | |
|---|---|---|---|---|
| 2,143,608 | A * | 1/1939 | Morris | 52/203 |
| 4,932,711 | A * | 6/1990 | Goebel | 296/97.7 |
| 4,951,909 | A | 8/1990 | Russo | |
| 5,012,850 | A | 5/1991 | Schrader | |
| 5,271,447 | A * | 12/1993 | Aronovich | 160/236 |
| 5,303,760 | A * | 4/1994 | Perez | 160/236 |
| 5,511,602 | A * | 4/1996 | Choi et al. | 160/370.21 |
| 6,023,866 | A * | 2/2000 | Polsky | 40/453 |
| 7,086,188 | B2 | 8/2006 | Tsao | |
| 7,124,893 | B2 * | 10/2006 | Winckels | 206/581 |
| 7,676,969 | B2 * | 3/2010 | Davis | 40/453 |
| 2003/0079386 | A1 * | 5/2003 | Noble | 40/453 |
| 2006/0086024 | A1 * | 4/2006 | Kennedy | 40/597 |
| 2008/0142170 | A1 | 6/2008 | Killian | |

OTHER PUBLICATIONS

Notification of Transmittal of the International Search Report and The Written Opinion of the International Searching Authority for counterpart PCT/US2012/040713, mailed Oct. 16, 2012.

* cited by examiner

*Primary Examiner* — Syed A Islam
(74) *Attorney, Agent, or Firm* — Joseph M. Butscher; The Small Patent Law Group, LLC

(57) ABSTRACT

An advertisement assembly is configured to be removably secured to a structure. The assembly includes a mounting sub-assembly configured to be removably secured to the structure, and a plurality of advertising members secured to the mounting sub-assembly. The plurality of advertising members are configured to be perpendicular to a surface of the structure. Each of the plurality of advertising members may include planar surfaces connected to front and rear edges. Graphics are displayed on the planar surfaces. The graphics are configured to be viewed from a first point of view or perspective. The plurality of advertising members provide a relatively unobstructed view through the assembly from a second point of view or perspective.

27 Claims, 11 Drawing Sheets

ADVERTISEMENT DISPLAY ASSEMBLY

RELATED APPLICATIONS

This application relates to and claims priority benefits from U.S. Provisional Patent Application No. 61/530,084, entitled "System and Method for Displaying Advertisements," filed Sep. 1, 2011, which is hereby incorporated by reference in its entirety.

This application also relates to and claims priority benefits from U.S. Provisional Patent Application No. 61/598,126, entitled "System and Method for Displaying Advertisements," filed Feb. 13, 2012, which is also hereby incorporated by reference in its entirety.

FIELD OF EMBODIMENTS OF THE INVENTION

Embodiments generally relate to a system and method for displaying advertisements, and, more particularly, to an assembly for displaying an advertisement from one point of view or perspective, while allowing a person to see through the assembly from a another point of view or perspective.

BACKGROUND

Various commercial enterprises offer goods for sale that may be contained within a transparent container. For example, various convenience stores offer refreshments for sale. Some of the refreshments, such as soft drinks and beer, are refrigerated. Often, the refreshments are contained within a refrigerated compartment having a transparent door (formed of glass, for example). The transparent door allows a customer to see the types of refreshments that are available for sale. If the customer chooses to purchase a particular refreshment, the customer opens the door, removes the refreshment within the refrigerated compartment, and then closes the door.

In order to attract customers, store owners sometimes place advertisements on the transparent doors. The advertisements may alert a customer to the presence of a particular product stored within a product-containing chamber, such as a refrigerated compartment behind a transparent door. Once an advertisement is on a door, however, the advertisement tends to block the view of items within the compartment, thereby defeating the purpose of the transparent doors.

SUMMARY OF EMBODIMENTS OF THE INVENTION

Embodiments provide a system and method of positioning advertisements on a compartment door that allows the advertisement to be viewed from a first point of view or perspective, while, at the same time, allowing products within the compartment to be viewed with minimal or no obstruction by the advertisements from another point of view or perspective.

Certain embodiments provide an advertisement assembly configured to be removably secured to a structure. The assembly may include a mounting sub-assembly configured to be removably secured to the structure, and a plurality of advertising members secured to the mounting sub-assembly. The advertising members may be configured to be perpendicular to a surface of the structure. Each of the advertising members may include planar surfaces connected to front and rear edges. Graphics may be displayed on the planar surfaces. The graphics are configured to be viewed from a first point of view or perspective. The advertising members provide a relatively unobstructed view through the assembly from a second point of view or perspective.

The mounting sub-assembly and the plurality of advertising members may be formed from a single piece of material. The single piece of material may be laminated paper. The mounting sub-assembly may include at least one bracket beam that folds out from the single piece of material. The plurality of advertising members may be unfolded from the single piece of material. In an embodiment, the mounting assembly may include top and bottom bracket beams secured to the advertising members. Each of the advertising members may be perpendicularly-oriented with respect to the top and bottom bracket beams.

The graphics on the planar surfaces of neighboring advertising members may be distorted, staggered, offset, overlapping, or the like. As such, the graphics may provide a contiguous image or message when viewed from the first point of view or perspective.

Each of the advertising members may include a propping or stabilizing protuberance configured to prop each of the plurality of advertising members away from a surface of the structure.

In an embodiment, the mounting assembly includes a plurality of brackets that securely retain portions of the plurality of advertising members. The brackets may be connected together through a connecting insert.

The mounting sub-assembly may include one or more suction cups configured to removably secure the assembly to the structure.

Each of the advertisement members may be formed of an opaque or transparent material.

The mounting sub-assembly and the advertisement members may be modular. That is, the assembly may be adapted and changed to include more or less advertising members.

Certain embodiments provide an advertisement assembly configured to be removably secured to a structure. The assembly may include a mounting sub-assembly configured to be removably secured to the structure. The mounting sub-assembly may include at least one bracket beam. The assembly may also include a plurality of advertising members secured to the at least one bracket beam. The advertising members may be configured to be perpendicular to a surface of the structure. Each of the advertising members may include planar surfaces connected to front and rear edges. Graphics may be displayed on the planar surfaces. The graphics are configured to be viewed from a first perspective. The advertising members provide a relatively unobstructed view through the assembly from a second perspective. The mounting sub-assembly and the plurality of advertising members may be formed from a single piece of material.

Certain embodiments provide an advertisement assembly configured to be removably secured to a structure. The assembly may include a mounting sub-assembly configured to be removably secured to the structure. The mounting sub-assembly may include a plurality of brackets, a connecting insert that connects the plurality of brackets, and one or more suction cups configured to removably secure the mounting sub-assembly to the structure. The assembly may also include a plurality of advertising members having portions securely retained by the plurality of brackets. The advertising members may be configured to be perpendicular to a surface of the structure. Each of the advertising members may include a propping or stabilizing protuberance configured to prop each of the advertising members away from a surface of the structure. Each of the advertising members may also include planar surfaces connected to front and rear edges. Graphics may be displayed on the planar surfaces. The graphics may be configured to be viewed from a first perspective. The advertising members provide a relatively unobstructed view through the assembly from a second perspective.

Certain embodiments provide a method of forming an advertisement assembly that includes forming a plurality of advertisement members and top and bottom bracket beams from a single piece of material, manipulating the plurality of advertisement members and top and bottom bracket beams so that the plurality of advertisement members lock in place with the bracket beams, forming the advertisement assembly through the manipulating, and securing the advertisement assembly to a transparent surface. Objects behind the transparent surface may be viewed from a first perspective. Advertisements on the advertisement assembly may be viewed from a second perspective that differs from the first perspective.

Figure 1:
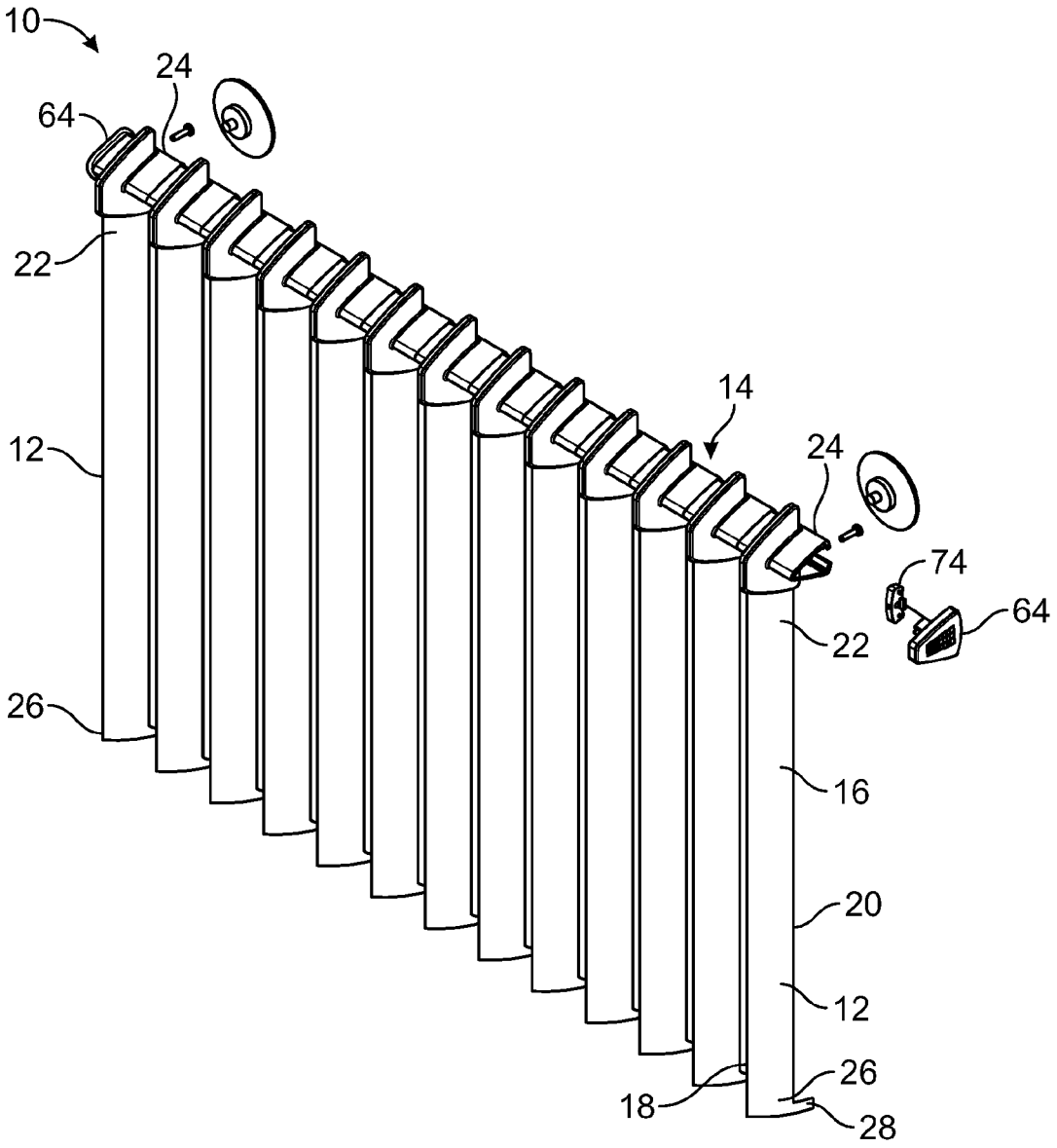
FIG. 1 illustrates an isometric top view of an advertisement assembly, according to an embodiment.

Before the embodiments are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE INVENTION

FIG. 1 illustrates an isometric top view of an advertisement assembly 10, according to an embodiment of the present invention. The advertisement assembly 10 includes a plurality of planar members 12, such as advertising members, secured to a mounting sub-assembly 14. The mounting sub-assembly 14 is configured to securely mount the advertising members 12 to a surface that is perpendicular to the planar advertising members 12. For example, the mounting sub-assembly 14 is configured to securely mount the advertising members 12 to a transparent product-compartment door or window, such as a transparent door of a refrigerated compartment within a convenience store, for example.

Each planar advertising member 12 may be a fin, panel, pane, strap, board, or the like, and includes opposed planar surfaces 16 integrally formed with front and rear edges 18 and 20, respectively. An upper end 22 of each planar advertising member 12 is secured within a bracket 24 of the mounting sub-assembly 14. A lower end 26 of each planar advertising member 12 may include a propping or stabilizing protuberance 28 extending away from the front edge 18. The propping or stabilizing protuberance 28 may be a support arm, post, barb, column, or the like that is configured to abut against a surface of the transparent product-compartment door. In this manner, the protuberances 28 are configured to prop and stabilize the advertising members 12 away from the surface of the product-compartment door or window.

Alternatively, each planar advertising member 12 may be sized and shaped so that a substantial portion directly contacts the product-compartment door or window. That is, the rear edge 20 of a bottom half, for example, of each advertising member 12 may be configured to directly contact the product-compartment door or window. Optionally, the rear edge 20 of a substantial majority, for example, of each advertising member 12 may be configured to directly contact the product-compartment door or window.

Each advertising member 12 may be formed of a solid, opaque material, such as plastic or metal. Optionally, each advertising member 12 may be formed of plywood, cardboard, paper, or the like. Alternatively, each advertising member 12 may be formed of a transparent material, such as plastic or glass. Graphics, such as advertisements, messages, text, images, pictures, and/or the like, may be affixed to or printed on, for example, to each opposed planar surface 16 of each advertising member 12. Moreover, the graphics may be formed on permanent or removable decals that may be placed on the planar surfaces 16 of the advertising members 12.

Figure 2:
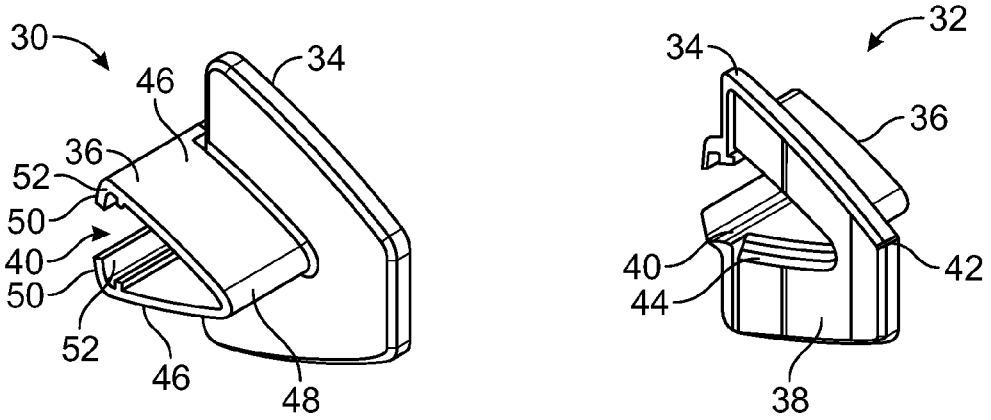
FIG. 2 illustrates an isometric top view of opposed bracket members, according to an embodiment.

FIG. 2 illustrates an isometric top view of opposed bracket members 30 and 32, according to an embodiment. The opposed bracket members 30 and 32 may be mirror images of one another. Each bracket member 30 and 32 may include a mating plate 34 integrally connected to an insert flange 36, which may extend perpendicularly outward from the mating plate 34. An interior surface 38 of each mating plate 34 may include slots, grooves, ridges, and the like that are configured to allow the opposed bracket members 30 and 32 to secure together, such as through a snapable connection. Optionally, the bracket members 30 and 32 may simply be press-fit together, such as through end caps (not shown in FIG. 2) that restrict the bracket members 30 and 32 from movement, such as axially shifting with respect to one another.

An insert channel 40 extends through the mating plate 34 and extends through the insert flange 36. A contiguous ridge 42 may extend from the interior surface 38 around a periphery of each mating plate 34. Additionally, a ridge 44 may extend from the interior surface 38 around the insert channel 40 of each mating plate 34. The ridges 42 and 44 are sized and shaped to be compatible with an upper end 22 of an advertising member 12 (shown in FIG. 1). That is, each upper end 22 of each advertising member 12 may be sized and shaped to conform to the shape of the mating plate 34 between the ridges 42 and 44. In this manner, the upper ends 22 of the advertising members 12 may be positioned between the opposed bracket members 30 and 32 and compressively sandwiched therebetween when the opposed bracket members 30 and 32 are securely connected together. The ridge 44, for example, may provide a hook or other such feature onto which the upper end 22 of an advertising member 12 is secured. Alternatively, the upper ends 22 of the advertising members 12 may simply be compressively sandwiched between the opposed bracket members 30 and 32.

The insert flange 36 includes angled beams 46 that connect to one another at a rounded apex 48. Terminal ends 50 of the angled beams 46 are separated from one another. Alternatively, the angled beams 46 may connect to one another through a rear beam, which eliminates any gap therebetween. Retaining ledges 52 are located at the terminal ends 50 and are generally perpendicular to the main portions of the angled beams 46. The insert flanges 36 are configured to receive and retain a connecting insert within the insert channels 40.

As shown in FIG. 2, the mounting plates 34 and the insert flanges 36 of the opposed bracket members 30 and 32 are generally wedge-shaped. However, the opposed bracket members 30 and 32 may be various other shapes and sizes. For example, the mounting plates 34 and/or the insert flanges 36 may be square, rectangular, circular, or various other shapes and sizes. The opposed bracket members 30 and 32 are configured to securely retain an upper end 22 of an advertising member 12 therebetween, while also allowing a connecting insert (not shown in FIG. 2) to pass therethrough.

Figure 3:
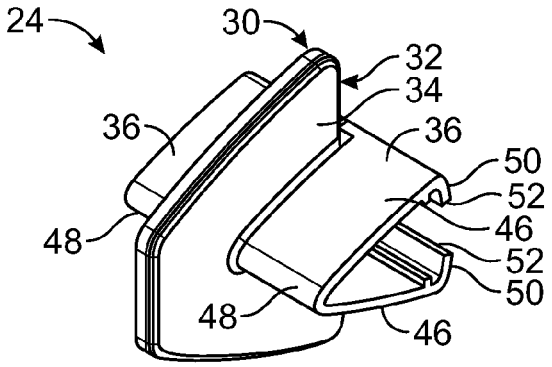
FIG. 3 illustrates an isometric top view of a bracket, according to an embodiment.

FIG. 3 illustrates an isometric top view of a bracket 24, according to an embodiment. As shown, the bracket members 30 and 32 are connected to one another. Referring to FIGS. 1 and 3, an upper end 22 of an advertising member 12 is configured to be secured between the opposed bracket members 30 and 32. The bracket 24 may be formed of metal, plastic, or the like.

Figure 4:
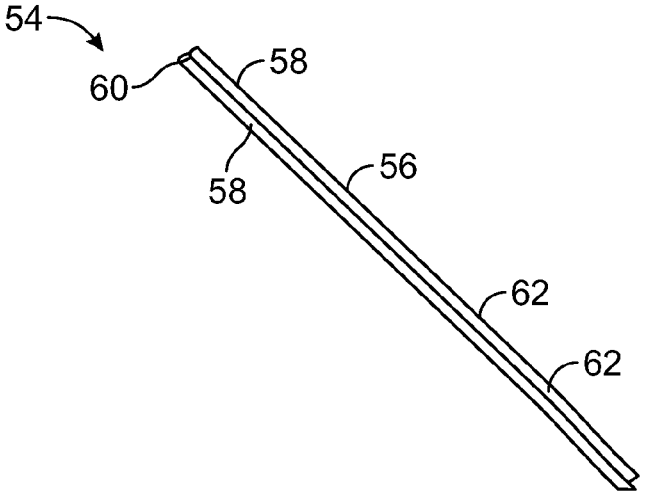
FIG. 4 illustrates an isometric view of a connecting insert, according to an embodiment.

FIG. 4 illustrates an isometric view of a connecting insert 54, according to an embodiment. The connecting insert 54 includes a longitudinal main body 56 having angled panels 58 connected to one another at a longitudinal apex 60. The connecting insert 54 may be formed of metal, plastic, paper, cardboard, plywood, or the like.

Referring to FIGS. 1, 3, and 4, the connecting insert 54 is configured to be slid into and through the insert channels 40 of the brackets 24. The apex 60 nests within the apexes 48 of the brackets 24, while free edges 62 of the angled panels 58 are retained within the brackets 24 by the retaining ledges 52. The connecting insert 54 connects the brackets 24 together. Therefore, the connecting insert 54 allows multiple advertising members 12 to be connected to the mounting sub-assembly 14. More brackets 24 may be added to the connecting insert 54. Additionally, brackets 24 may be removed from the connecting insert 54. Thus, the assembly 10 is modular and may be tailored to the specific size and preferences of a store owner, for example.

Figure 5:
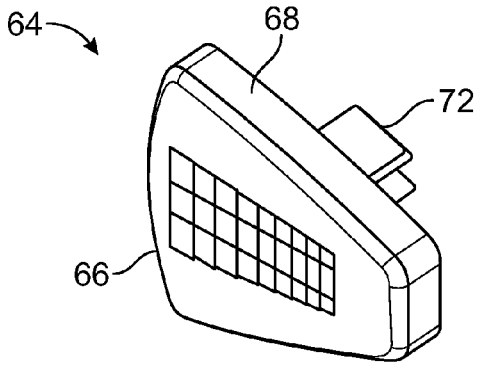
FIG. 5 illustrates an isometric outer view of an end cap, according to an embodiment.
Figure 6:
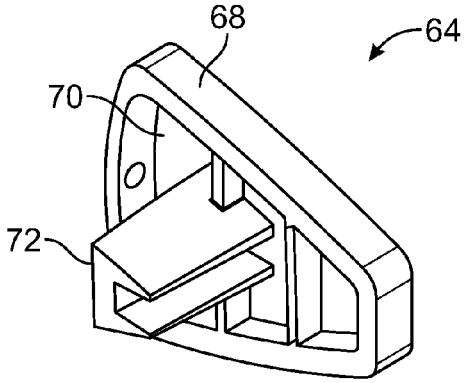
FIG. 6 illustrates an isometric inner view of an end cap, according to an embodiment.

FIGS. 5 and 6 illustrate isometric outer and inner views, respectively, of end caps 64, according to an embodiment. Referring to FIGS. 5 and 6, opposed end caps 64 may be mirror images of one another. Each end cap 64 includes a planar outer surface 66 connected to an outer rim 68. The outer surface 66 and rim 68 may be sized and shaped to conform to the size and shape of the insert flanges 36 of the brackets 24 (shown in FIGS. 1-3). The outer surface 66 and the rim 68 define an internal recessed area 70, from which a connecting stud 72 extends. Referring to FIGS. 1, 5 and 6, the end caps 64 are positioned at ends of the mounting sub-assembly 14 and may be configured to removably secure, such as through a snapable engagement, with terminal brackets 24. The connecting studs 72 may be configured to be positioned within terminal insert channels 40, between the angled panels 58 of the connecting insert 54. In this manner, the end caps 64 secure the brackets 24 in place. That is, the opposed end caps 64 at ends of the mounting sub-assembly 14 securely compress the brackets 24 together, and may prevent the brackets 24 from axially shifting with respect to the longitudinal axis of the connecting insert 54 (shown in FIG. 4). Optionally, an adapter 74 may be disposed between each end cap 64 and a terminal bracket 24.

Figure 7:
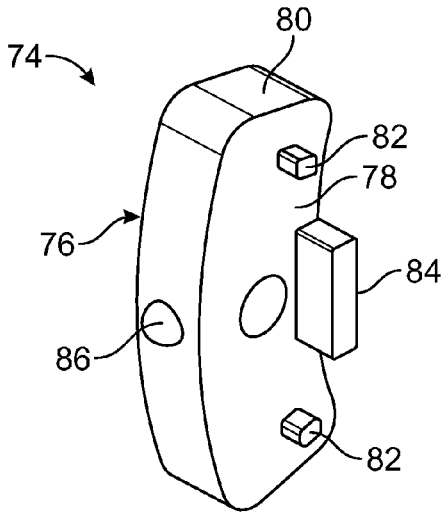
FIG. 7 illustrates an isometric view of an adapter, according to an embodiment.

FIG. 7 illustrates an isometric view of an adapter 74, according to an embodiment. The adapter 74 may be sized and shaped to securely connect an end cap 64 to a bracket 24. The adapter 74 includes a main body 76 having a planar outer surface 78 integrally connected to an outer edge 80. The outer surface 78 may include studs 82 and a block 84 extending therefrom that may be configured to cooperate with reciprocal structures on the end caps 64 and/or the brackets 24 to secure thereto. Additionally, the outer edge 80 may include a fastener hole 86 configured to receive and retain a fastening stud of a suction cup, for example.

Figure 8:
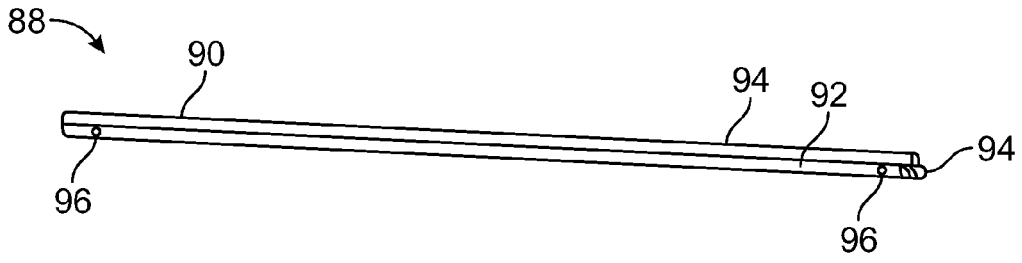
FIG. 8 illustrates an isometric rear view of a bracket rail, according to an embodiment.

FIG. 8 illustrates an isometric rear view of a bracket rail 88, according to an embodiment. The bracket rail 88 includes a longitudinal main body 90 having a planar beam 92 integrally connected to angled clamp beams 94. Referring to FIGS. 1-3, the bracket rail 88 may be configured to securely clamp onto or into the insert flanges 36 of the brackets 24. For example, the clamp beams 94 may securely clamp over free ends of the angled beams 46 of the insert flanges 36. Alternatively, the clamp beams 94 may securely clamp between the angled beams 46 of the insert flanges 36. The bracket rail 88 may also include through-holes 96 configured to receive and retain connection members, such as studs, of suction cups, for example.

While a separate and distinct bracket rail 88 is shown, the brackets 24 may alternatively include a rear wall between the angled beams 46 that replaces the bracket rail 88. In this manner, as the brackets 24 are connected together through the connecting insert 54 (shown in FIG. 4), the integral rear walls connecting the free ends of the angled beams 46 replace the bracket rail 88.

Figure 9:
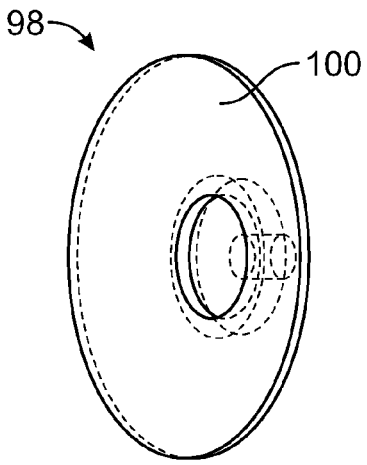
FIG. 9 illustrates an isometric front view of a suction cup, according to an embodiment.
Figure 10:
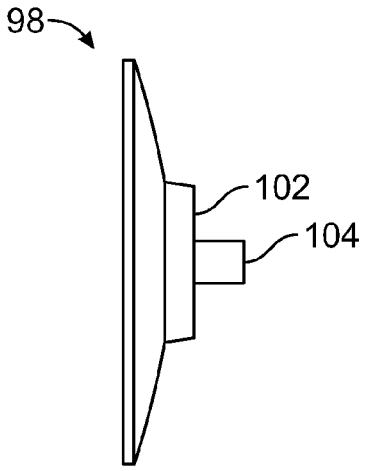
FIG. 10 illustrates a lateral view of a suction cup, according to an embodiment.

FIG. 9 illustrates an isometric front view of a suction cup 98, according to an embodiment. FIG. 10 illustrates a lateral view of the suction cup 98. Referring to FIGS. 9 and 10, the suction cup 98 includes an annular suction member 100 connected to a base 102, which is, in turn, connected to a connection stud 104. Referring to FIGS. 1, 9, and 10, the suction cups 98 may securely connect to the mounting sub-assembly 14 by way of the connection studs 104 securing into through-holes, such as formed in the bracket rail 88 (shown in FIG. 8), the adapters (shown in FIG. 7), or even the brackets 24 themselves. The suction cups 98 are configured to secure the assembly 10 to a surface, such as a glass door or window.

Alternatively, the assembly 10 may be secured to a surface through various other methods and devices. For example, instead of suction cups, the assembly 10 may simply be hung from a support bracket that surrounds the surface. In one example, the support bracket may include hooks, while the assembly includes a string or rope that hooks onto, or is tied to, the hooks. Additionally, the assembly 10 may be secured to the surface through adhesives, such as two-way tape.

Figure 11:
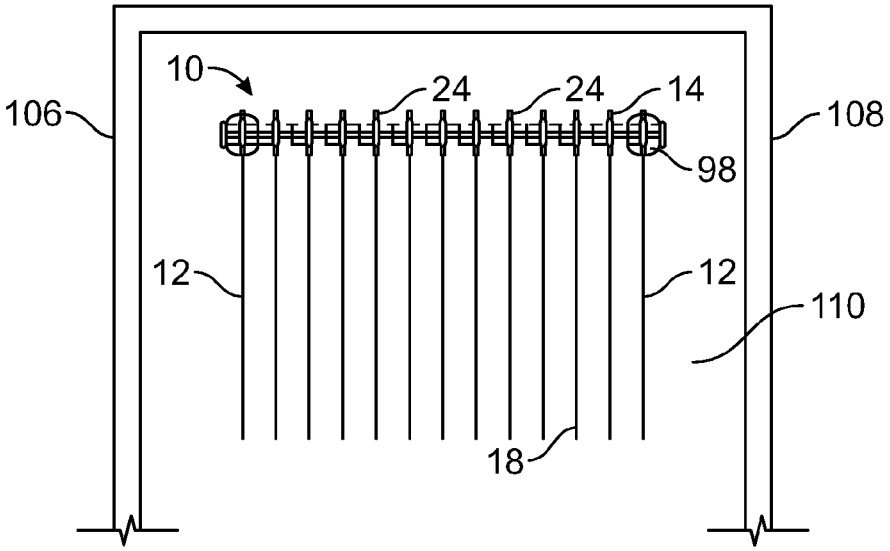
FIG. 11 illustrates a front view of an advertisement assembly secured to a structure, according to an embodiment.

FIG. 11 illustrates a front view of the advertisement assembly 10 secured to a structure 106, according to an embodiment. The structure 106 may be a refrigerator compartment, such as found at convenience and grocery stores, having a frame 108 that securely retains a transparent window 110, which may be formed of glass, or a transparent thermoplastic, such as acrylic glass or polymethyl methacrylate. However, the structure 106 may be various other structures, such as a window, door, wall, or the like.

As shown, the mounting sub-assembly 14 secures the advertising members 12 over the window 110. The advertising members 12 are perpendicularly oriented with respect to the surface of the window 110. Thus, when a customer views the assembly 10 from straight on, the customer sees the front edges 18 of the advertisement assembly 10, but is otherwise able to see into the structure 106 through the window 110.

Figure 12:
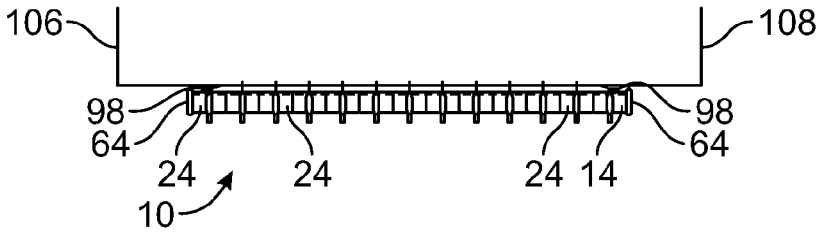
FIG. 12 illustrates a top view of an advertisement assembly secured to a structure, according to an embodiment.

FIG. 12 illustrates a top view of the advertisement assembly 10 secured to the structure 106. As shown in FIGS. 11 and 12, the suction cups 98 secure the assembly 10 to the window 110. The brackets 24 are securely sandwiched together by way of the connecting insert 54 passing therethrough, and the end caps 64 restraining axial shifting of the brackets 24. Notably, an end cap 64 may be removed so that brackets 24 may be slid off and removed. A shorter connecting insert 54 may replace the connecting insert 54. Optionally, a longer connecting insert 54 may be used so that additional brackets 24 and advertising members 12 may be used. In this manner, the assembly 10 provides a modular advertisement assembly 10 that may be adapted to provide more or less advertising members 12, based on the preference of a store owner, for example.

Figure 13:
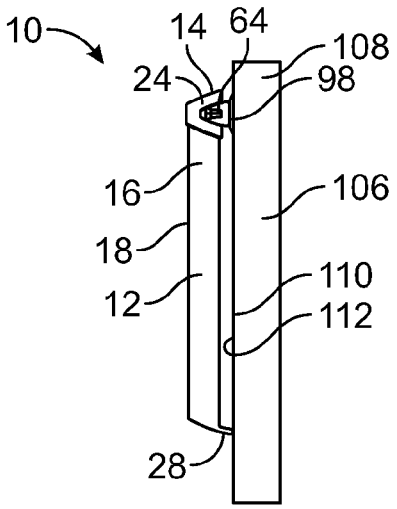
FIG. 13 illustrates a side view of an advertisement assembly secured to a structure, according to an embodiment.

FIG. 13 illustrates a side view of the advertisement assembly 10 secured to the structure 106. As shown in FIG. 13, when a customer views the assembly from a side of the structure, or a direction that is parallel to the surface 112 of the window 110, the customer sees the planar surfaces 16 of the advertising members 12. As noted above, the planar surfaces 16 may include advertisements or messages printed or secured thereto, which entice the customer before the customer is able to see the interior contents of the structure 106.

As also shown in FIG. 13, the propping or stabilizing protuberances 28 prop the main portions of the advertising members 12 away from the surface 112 of the window 110. Additionally, the protuberances 28 stabilize the advertising members 12 with respect to the window, so that the advertising members 12 do not pivot about upper ends with lower ends periodically moving into and away from the window.

Figure 14:
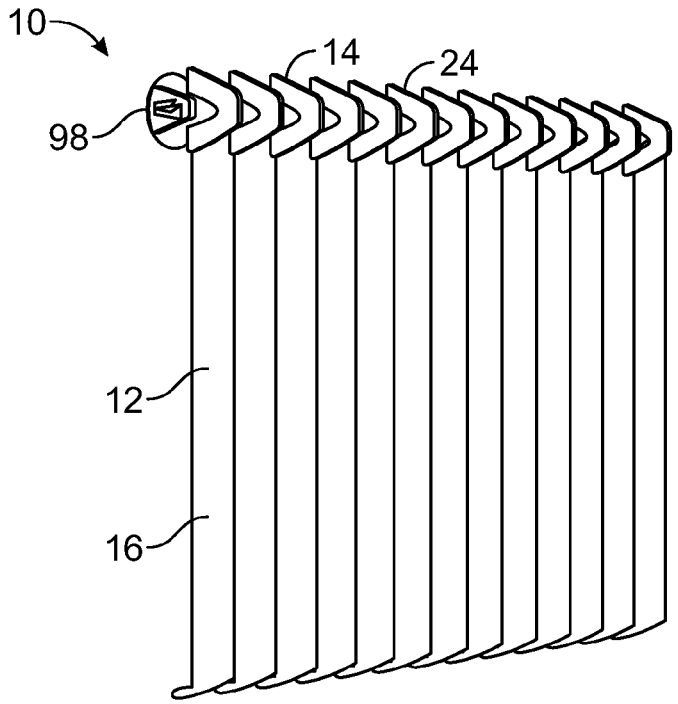
FIG. 14 illustrates an isometric view of an advertisement assembly from a first side, according to an embodiment.
Figure 15:
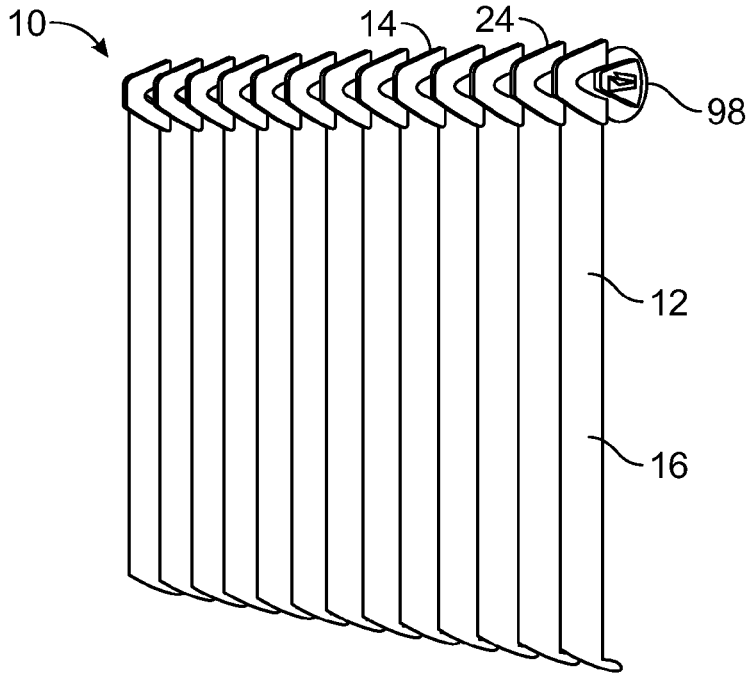
FIG. 15 illustrates an isometric view of an advertisement assembly from a second side, according to an embodiment.

FIG. 14 illustrates an isometric view of the advertisement assembly 10 from a first side, according to an embodiment. FIG. 15 illustrates an isometric view of the advertisement assembly 10 from a second side, according to an embodiment. Referring to FIGS. 14 and 15, the advertising members 12 may include graphics, such as advertising and/or messages, on both planar surfaces 16. Moreover, the graphics may be staggered with respect to neighboring advertising members 12 so that as a customer passes by, an intelligible, contiguous message appears on the plurality of advertising members 12. As the customer passes by, the staggered advertisements and/or messages may appear to move or change based on the movement of the customer.

As shown in FIGS. 14 and 15, from one perspective or point of view, the graphics are visible to the customer. As shown, the perspective or point of view may be from a position in which the customer is to a side of a structure onto which the advertisement assembly 10 is secured, such that the customer is not directly in front of the structure.

However, as shown in FIG. 11, from another perspective or point of view, the customer sees only the edges of the advertising members 12 and is able to see into the structure onto which the assembly 10 is secured. As such, the customer has a relatively unobstructed view through the assembly 10 from the point of view directly in front of the assembly 10. As shown in FIG. 11, the other perspective or point of view may be from a position in which the customer is directly in front of the structure onto which the assembly 10 is secured.

When viewed from a side, the lateral planar surfaces of the planar advertising members 12 are clearly visible. Therefore, advertisements on the advertising members 12 may be viewed from a side. However, as a customer moves in front of a compartment, he/she will see through the gaps of the assembly 10 (and, if the advertising members 12 are transparent, through edges of the advertising members 12 themselves), such as shown in FIG. 11. Therefore, the customer will be able to clearly see through the transparent door, into the compartment, such as a refrigerated compartment or cold vault that stores cooled refreshments.

Figure 16:
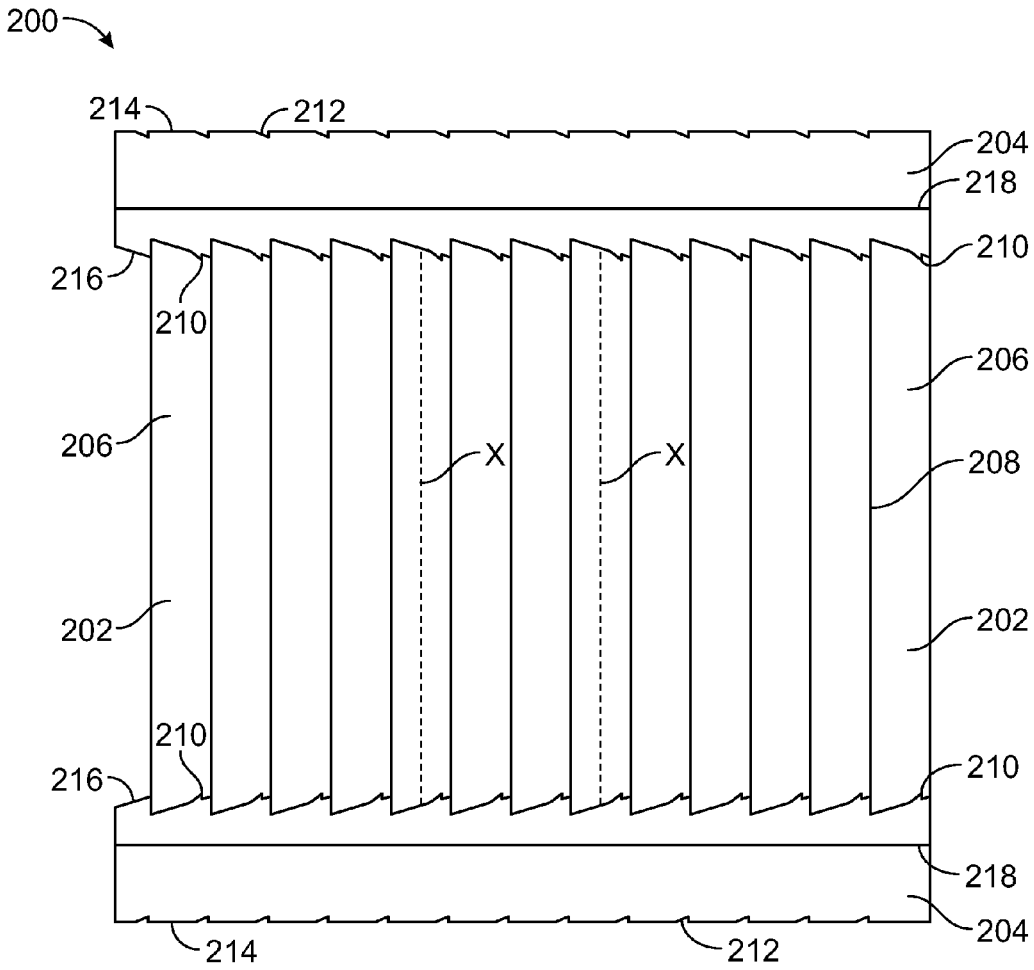
FIG. 16 illustrates a front view of a pre-formed advertisement assembly, according to an embodiment.

FIG. 16 illustrates a front view of a pre-formed advertisement assembly 200, according to an embodiment. The assembly 200 may be formed from a single piece of laminated paper, which may then be cut, scored, and/or the like to form a plurality of planar advertising members 202, such as vertical fins, panels, panes, straps, boards, or the like, that are integrally formed and connected with horizontal end bracket beams 204 positioned at opposite ends of the advertising members 202.

Each advertising member 202 includes mirror-image panels 206 pivotally secured to one another through an integral crease, hinge, or the like 208. Securing notches 210 or slots are formed at each end of each advertising member 202. The mirror-image panels 206 are not necessarily mirror images with respect to printed graphics thereon. Instead, the panels 206 may be mirror images in that they are structurally symmetrical about the integral crease 208, for example.

Each bracket beam 204 is generally perpendicularly-oriented with respect to the longitudinal axes X of the advertising members 202. Each bracket beam 204 may include reciprocal securing members 212, such as tabs or the like positioned along outer edges 214. Optionally, the advertising member 202 may include the securing members, while the bracket beams 204 include the securing notches or slots.

A horizontal crease 218 is formed along a length of each bracket beam 204. The crease 218 may be formed at, or proximate to, a center, longitudinal axis of each bracket beam 204. As shown in FIG. 16, the crease 218 may be located closer to an inner edge 216 of the bracket beam 204 than the outer edge 214.

Each side of the assembly 200 may be printed with full color graphics on each side. The pre-formed assembly 200 or substrate may be cut (such as through use of a die) and scored to allow the assembly 200 to be folded and locked into position, as described below.

Figure 17:
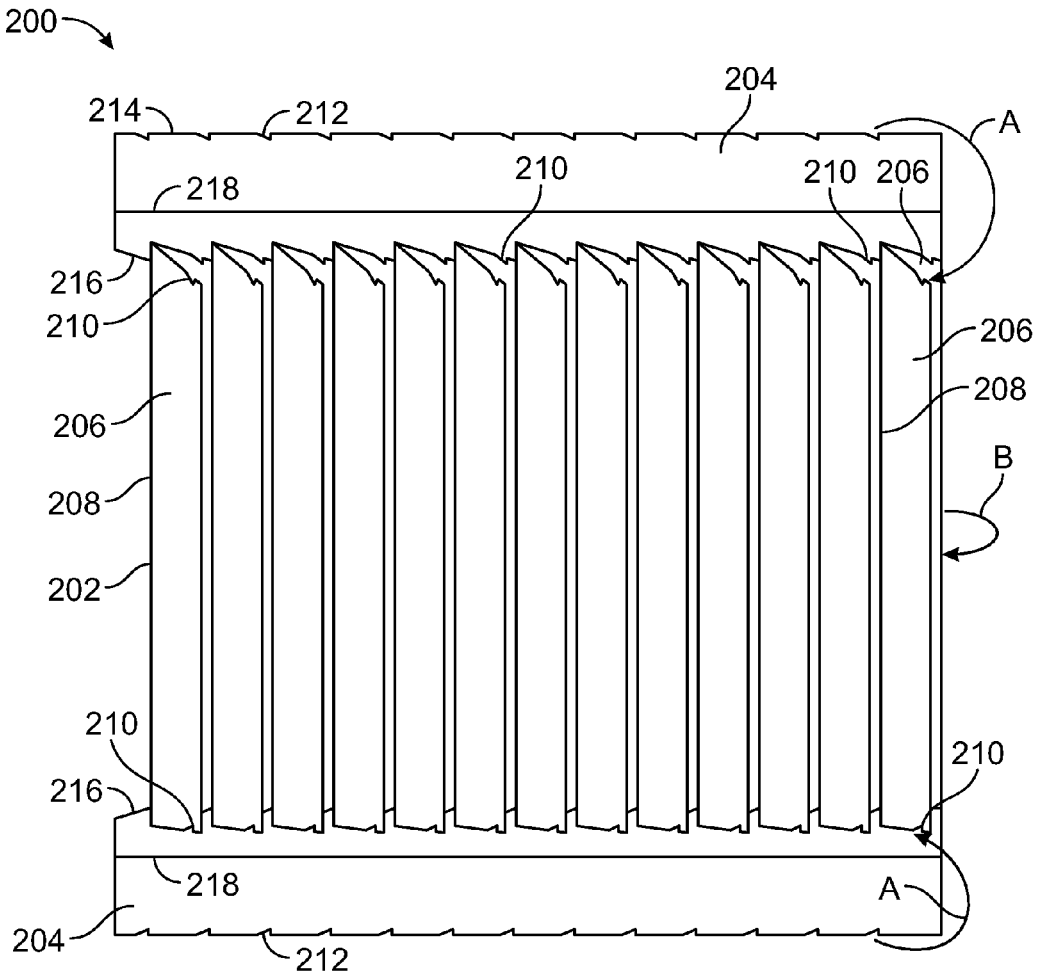
FIG. 17 illustrates a front view of an advertisement assembly being formed, according to an embodiment.

FIG. 17 illustrates a front view of the advertisement assembly 200 being formed, according to an embodiment. The outer edge 214 of each bracket beam 204 may be folded over toward the inner edge 216 in the direction of arc A about the crease 218. Further, each advertising member 202 may be folded out in the direction of arc B, so that the mirror-image panels 206 pivot away from one another about the creases 208. The panels 206 may be pivoted away from one another so that the opposed panels 206 lie within a common plane that is configured to be normal (or otherwise perpendicular) to the flat surface plane of a cooler door, for example. That is, the unfolded panels 106 may form a single planar advertising member 202. The securing members 212 of the bracket beams 204 are then mated with the notches 210 of the advertising members 202. For example, the securing members 212 of the inner edge 216 of the bracket beam 204 may securely mate with notches 210 of one panel 206 of each advertising member 202, while the securing members 212 of the outer edge 214 of the bracket beam 204 may securely mate with notches 210 of the opposed panel 206 of each advertising member 202. In this manner, the bracket beams 204 lock into place with the advertising members 202.

One or both of the bracket beams 204 may form a mounting sub-assembly. Securing members, such as suction cups, adhesives, or the like, may be secured to the mounting sub-assembly formed by one or more of the bracket beams 204 so that the assembly 200 may be secured to a surface of a structure, as described above.

Figure 18:
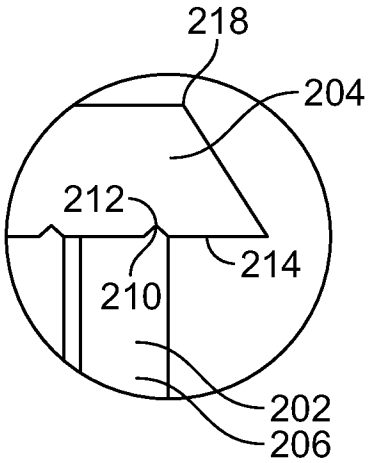
FIG. 18 illustrates a close-up view of a bracket securely mated with fins, according to an embodiment.

FIG. 18 illustrates a close-up view of the bracket beam 204 securely mated with the advertising members 202, according to an embodiment. As shown, each advertising member 202 has been unfolded, as described above, to form a single planar advertising member 202 that resides in a common plane.

Figure 19:
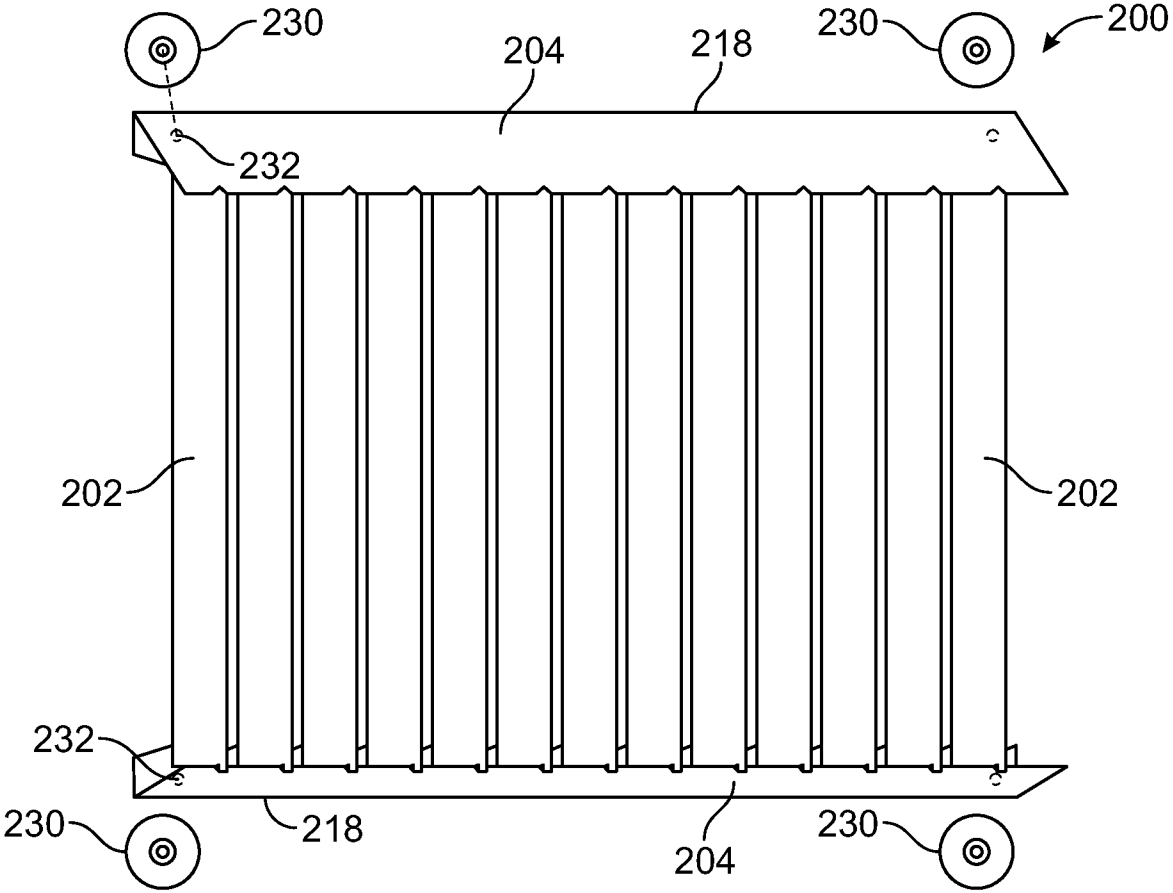
FIG. 19 illustrates an isometric front view of an advertisement assembly and securing members, according to an embodiment.

FIG. 19 illustrates an isometric front view of the advertisement assembly 200 and mounting members 230, according to an embodiment. Aligned holes 232 may be formed through the bracket beams 204. The holes 232 may be configured to receive reciprocal posts, studs, hooks, protuberances, or the like, extending from the mounting members 230, such as suction cups, that are used to fasten the assembly 200 to a cooler door, for example. Optionally, instead of suction cups, the assembly 200 may be secured to a door, window, panel, or other such surface through other mounting members, such as double-sided tape, glue, or the like. When the advertising members 202 are unfolded into the fully-formed state and secured to the top and bottom bracket beams 204, as shown in FIG. 19, the planar advertising members 202 provide planar surfaces that display graphics, such as advertisements, messages, and/or the like. As shown in FIG. 19, the advertising members 202 may be vertical, for example, and the top and bottom bracket beams 204 may be horizontal. Thus, the advertising members 202 may be perpendicularly-oriented with respect to the top and bottom bracket beams 204.

Similar to the embodiments described above, when a customer views the assembly straight on in front of edge ends of the advertisement members 202, the customer sees the edges of the planar advertising members 202, but is otherwise able to see through the gaps between the advertising members 202. However, when the customer views the assembly from another point of view or perspective, such as from the side, the customer sees the graphics, such as advertisements, messages, or the like that are displayed on the planar surfaces of the advertising members 202.

Thus, the assembly 200 provides an advertisement assembly that may be economically formed from a single piece of material, and quickly and easily assembled. As such, the assembly 200 may be formed without the need for separate and distinct pieces, fasteners, and the like. Instead, the assembly 200 may be cut from a single piece of material, and formed and assembled entirely through the pieces of the single piece of material, as discussed above.

Alternatively, the assembly 200 may be formed such that the individual components are cut from the single piece of material. For example, instead of folding and rotating components to form the assembly 200, each individual component may be cut and removed from the single piece of material, and secured together to form the assembly. For example, the panels may be removed from the single piece of material, unfolded and formed into planar advertising members, which may then be secured to the brackets beams.

Figure 20:
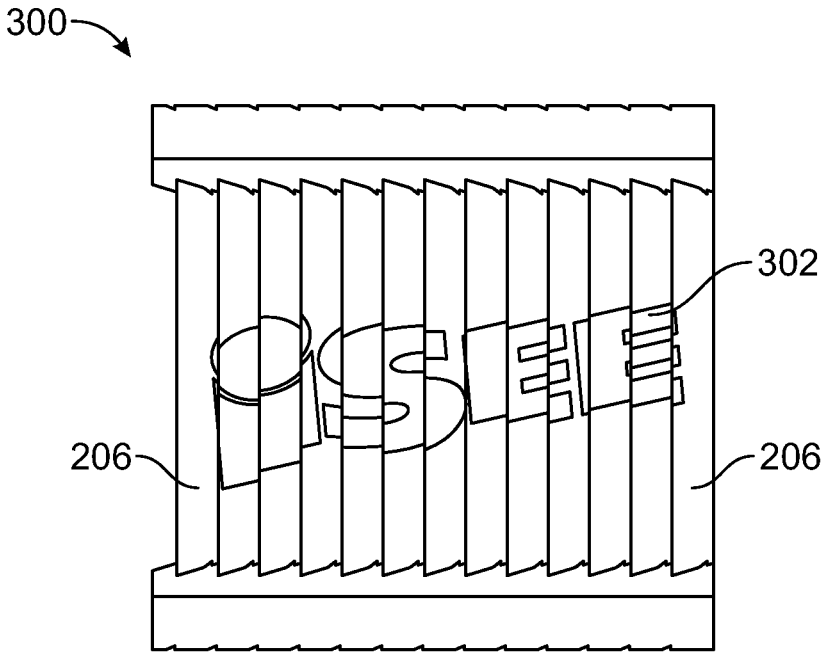
FIG. 20 illustrates a front view of a pre-formed advertisement assembly having printed graphics, according to an embodiment.

FIG. 20 illustrates a front view of a pre-formed advertisement assembly 300 having printed graphics 302, according to an embodiment. The assembly 300 may be the same as the assembly 200, except that FIG. 20 illustrates explicit graphics printed on the pre-formed assembly. The graphics 302 may be staggered, offset, and/or distorted on the panels 206. The staggering, offsetting, and/or distortion of the graphics 302 are configured to provide an intelligible, seamless image when the panels 206 are unfolded into planar advertising members that are secured to the bracket beams as described above. That is, while the graphics 302 appear distorted while on a flat piece of material, when the assembly 300 is fully-formed, the graphics 302 cooperate to provide an intelligible image, message, or the like.

Figure 21:
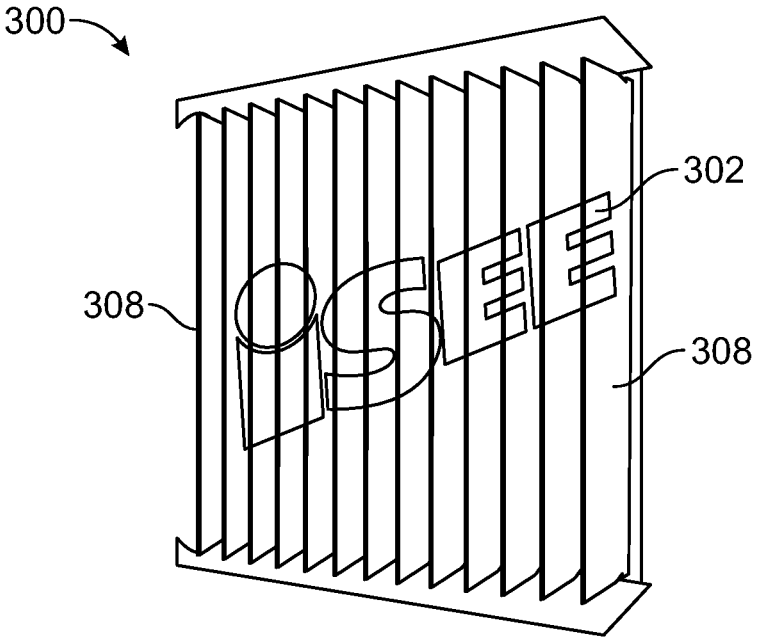
FIG. 21 illustrates an isometric front view of an assembled advertisement assembly having printed graphics, according to an embodiment.

FIG. 21 illustrates an isometric front view of an assembled advertisement assembly 300 having the printed graphics 302, according to an embodiment. As shown in FIG. 21, the graphics 302 may be printed on each advertising member 308 to allow resulting images on the advertising members 308 to line up to form a complete visual image to the viewer when viewing the assembly 300 from an angle (other than an edge view of the advertising members 308). The graphics 302 may be staggered and/or distorted and may overlap to a degree. The overlap may gradually vary to take perspective into account. Thus, as shown in FIG. 21, a resulting graphic is produced when the assembly 300 is fully assembled.

Graphics may be printed on or attached to the advertising members of all of the embodiments discussed above in a similar manner. That is, the graphics may be staggered, offset, distorted, or the like so that portions overlap (when the advertising members are aligned along a common plane, such as shown in FIG. 20). The overlap of the graphics between neighboring advertising members when oriented along a common plane produces an intelligible image or message to a customer when the assembly is fully formed, and the customer passes by the advertisement assembly.

Thus, the embodiments shown and described with respect to FIGS. 16-21 provide an advertisement assembly that may be formed from a single piece of material, such as laminated paper. The single piece of material may be cut, scored, and the like, so that the advertising members and bracket beams may be formed through folding and manipulation. In this manner, the embodiments shown and described with respect to FIGS. 16-21 provide an inexpensive advertisement assembly that may be formed from inexpensive materials, such as paper.

Embodiments provide an advertisement assembly that may be disposable. Embodiments provide an assembly that may be formed from a single piece of disposable material, such as paper. The assembly displays advertisements and/or graphics to consumers as they walk down an aisle toward a product.

Indeed, embodiments may be used with respect to any product racks within a store, and are not limited to being placed on windows, doors, or the like. When a consumer is positioned in front of the product, the advertisement assembly does not obstruct the view of the product.

Figure 22:
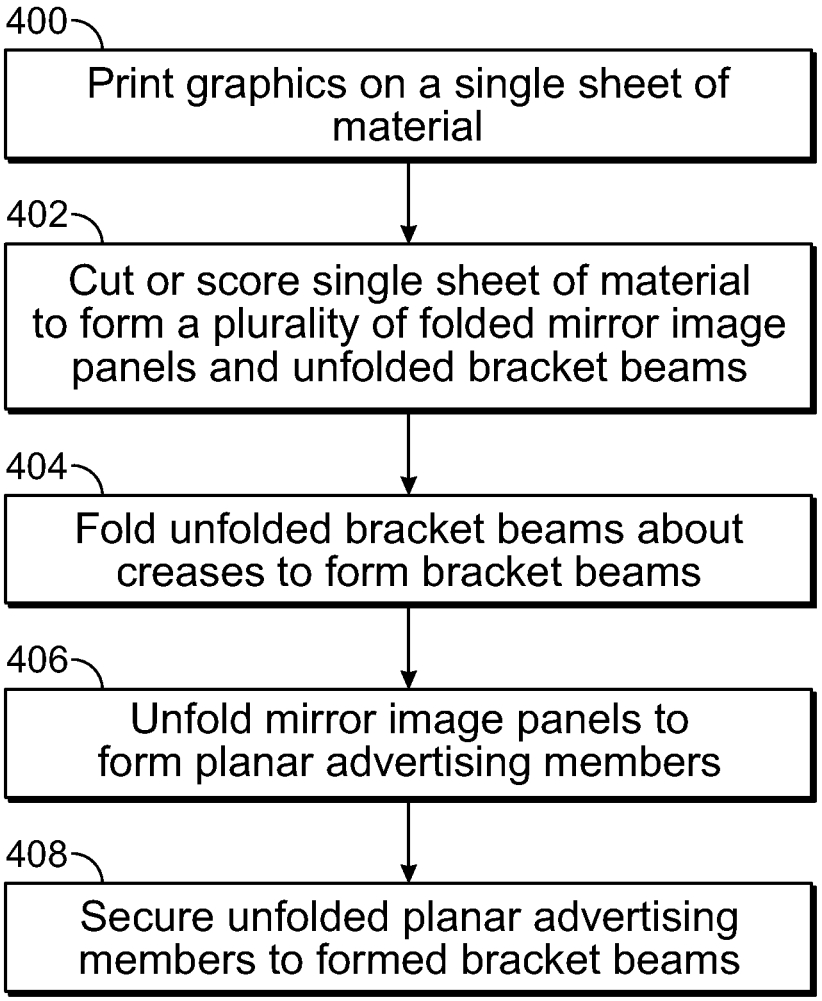
FIG. 22 illustrates a flow chart of a method of forming an advertisement assembly, according to an embodiment.

FIG. 22 illustrates a flow chart of a method of forming an advertisement assembly, according to an embodiment. At 400, graphics are printed on a single sheet of material, such as laminated paper. The graphics may be staggered, offset, distorted, or the like so that portions may overlap. The overlap of graphics with respect to eventual neighboring advertising members is configured to provide an intelligible graphic display that may appear to move with a moving individual when the assembly is fully formed and positioned on a structure.

At 402, the single sheet of material is cut, scored, perforated, and or the like to define a plurality of folded mirror image panels and unfolded bracket beams. In general, the graphics are printed so that they properly align with the panels, based on preference. Next, at 404, the unfolded bracket beams are folded about creases to form the bracket beams. Then, at 406, the mirror image panels are unfolded to form planar advertising panels. That is, the mirror image panels are unfolded about a connecting crease, for example, so that the panels form planar advertising members. Finally, at 408, the unfolded planar advertising members are secured to the formed bracket beams, such as by way of tabs being secured into slots, notches, or the like.

Referring to FIGS. 1-22, embodiments provide advertisement assemblies that may position a series of planar members (such as planar advertising members) at a 90° angle with respect to a product on a rack, within a cooler, or the like. When the consumer views the advertisement assemblies from a side (such as when walking down an aisle), the advertising members align to form a complete graphic image. When the consumer reaches the product, the consumer views the edges of the advertising members, and is therefore able to see the product behind the assembly through the gaps between the advertising members. As such, the consumer may see only the thin edges of the advertising members when viewing the product straight-on. Embodiments provide advertising assemblies that create a visual surprise to a consumer when walking down an aisle, thereby attracting the consumer to the product being promoted.

While various spatial and directional terms, such as top, bottom, lower, mid, lateral, horizontal, vertical, front and the like may be used to describe embodiments, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions, types of materials and coatings described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

Various features of the invention are set forth in the following claims.

The invention claimed is:

1. An advertisement assembly removably secured to an outer side of a transparent upright surface of a structure, the assembly comprising:

a mounting sub-assembly removably secured to the outer side of the transparent upright surface of the structure; and a plurality of advertising members secured to the mounting sub-assembly, wherein each of the plurality of advertising members comprises: (i) planar surfaces connected to front and rear edges; and (ii) a propping protuberance that props each of the plurality of advertising members away from the outer side of the transparent upright surface of the structure, wherein graphics are displayed on the planar surfaces, and wherein the graphics are configured to be viewed from a first point of view, and wherein the plurality of advertising members provide a relatively unobstructed view through the assembly from a second point of view.

2. The assembly of claim 1, wherein the mounting sub-assembly and the plurality of advertising members are formed from a single piece of material.

3. The assembly of claim 2, wherein the single piece of material is laminated paper.

4. The assembly of claim 2, wherein the mounting sub-assembly comprises at least one bracket beam that folds out from the single piece of material, and wherein the plurality of advertising members are unfolded from the single piece of material.

5. The assembly of claim 1, wherein the mounting assembly comprises top and bottom bracket beams secured to the plurality of advertising members, wherein each of the plurality of advertising members are perpendicularly-oriented with respect to the top and bottom bracket beams.

6. The assembly of claim 1, wherein the graphics on the planar surfaces of neighboring ones of the plurality of advertising members are distorted, wherein the distorted graphics provide a contiguous image or message when viewed from the first point of view.

7. The assembly of claim 1, wherein the mounting sub-assembly comprises a plurality of brackets that securely retain portions of the plurality of advertising members.

8. The assembly of claim 7, wherein the plurality of brackets are connected together through a connecting insert.

9. The assembly of claim 1, wherein the mounting sub-assembly comprises one or more suction cups configured to removably secure the assembly to the structure.

10. The assembly of claim 1, wherein each of the plurality of advertisement members is formed of a transparent material that allows viewing completely through each of the plurality of advertisement members.

11. The assembly of claim 1, wherein the mounting sub-assembly and the plurality of advertisement members are modular so that a size of the mounting sub-assembly is changeable and a number of the plurality of advertisement members is changeable.

12. The assembly of claim 1, wherein the plurality of advertising members are configured to be perpendicular to the transparent upright surface of the structure.

13. An advertisement assembly removably secured to a structure, the assembly comprising:

a mounting sub-assembly removably secured to the structure, wherein the mounting sub-assembly comprises at least one bracket beam; and a plurality of advertising members secured to the at least one bracket beam, wherein each of the plurality of advertising members comprises planar surfaces connected to front and rear edges, wherein graphics are displayed on the planar surfaces, and wherein the graphics are configured to be viewed from a first perspective, and wherein the plurality of advertising members provide a relatively unobstructed view through the assembly from a second perspective, wherein the mounting sub-assembly and the plurality of advertising members are formed from a single piece of material.

14. The assembly of claim 13, wherein the single piece of material is laminated paper.

15. The assembly of claim 13, wherein the at least one bracket beam folds out from the single piece of material, and wherein the plurality of advertising members are unfolded from the single piece of material.

16. The assembly of claim 13, wherein the at least one bracket beam comprises top and bottom bracket beams secured to the plurality of advertising members, wherein each of the plurality of advertising members are perpendicularly-oriented with respect to the top and bottom bracket beams.

17. The assembly of claim 13, wherein the graphics on the planar surfaces of neighboring ones of the plurality of advertising members are distorted, wherein the distorted graphics provide a contiguous image or message when viewed from the first perspective.

18. The assembly of claim 13, wherein the mounting sub-assembly comprises one or more suction cups configured to removably secure the assembly to the structure.

19. The assembly of claim 13, wherein each of the plurality of advertisement members is formed of a transparent material that allows viewing completely through each of the plurality of advertisement members.

20. The assembly of claim 13, wherein the plurality of advertising members are configured to be perpendicular to a surface of the structure.

21. An advertisement assembly removably secured to an outer side of an upright transparent surface of a structure, the assembly comprising:

a mounting sub-assembly removably secured to the outer side of the upright transparent surface of the structure, wherein the mounting sub-assembly comprises a plurality of brackets, a connecting insert that connects the plurality of brackets, and one or more suction cups configured to removably secure the mounting sub-assembly to the structure; and a plurality of advertising members having portions securely retained by the plurality of brackets, wherein each of the plurality of advertising members comprises a propping protuberance that props each of the plurality of advertising members away from the outer side of the transparent upright surface of the structure, wherein each of the plurality of advertising members comprises planar surfaces connected to front and rear edges, wherein graphics are displayed on the planar surfaces, and wherein the graphics are configured to be viewed from a first perspective, and wherein the plurality of advertising members provide a relatively unobstructed view through the assembly from a second perspective.

22. The assembly of claim 21, wherein the graphics on the planar surfaces of neighboring ones of the plurality of advertising members are distorted, wherein the distorted graphics provide a contiguous image or message when viewed from the first perspective.

23. The assembly of claim 21, wherein each of the plurality of advertisement members is formed of a transparent material that allows viewing completely through each of the plurality of advertisement members.

24. The assembly of claim 21, wherein the mounting sub-assembly and the plurality of advertisement members are modular so that a size of the mounting sub-assembly is changeable and a number of the plurality of advertisement members is changeable.

25. A method of forming an advertisement assembly, comprising:

forming a plurality of advertisement members and top and bottom bracket beams from a single piece of material;

manipulating the plurality of advertisement members and top and bottom bracket beams so that the plurality of advertisement members lock in place with the bracket beams;

forming the advertisement assembly through the manipulating; and securing the advertisement assembly to an outer side of an upright transparent surface of a refrigerated compartment, wherein objects behind the upright transparent surface may be viewed from a first perspective, and wherein advertisements on the advertisement assembly may be viewed from a second perspective that differs from the first perspective.

26. The method of claim 25, wherein the manipulating comprises unfolding the plurality of advertisement members from the single piece of piece of material, and folding out the top and bottom bracket beams from the single piece of material.

27. The assembly of claim 21, wherein the plurality of advertising members are configured to be perpendicular to the upright transparent surface of the structure.

* * * * *